United States Patent [19]

Kato

[11] Patent Number: 4,592,500

[45] Date of Patent: Jun. 3, 1986

[54] TAG-PIN DISPENSING MACHINE

[75] Inventor: Masami Kato, Nagoya, Japan

[73] Assignee: Toska Co., Ltd., Tokyo, Japan

[21] Appl. No.: 700,949

[22] Filed: Feb. 12, 1985

[30] Foreign Application Priority Data

Jul. 17, 1984 [JP] Japan ..... 59-146745

[51] Int. Cl.[4] ..... B65L 5/06

[52] U.S. Cl. ..... 227/67

[58] Field of Search ..... 227/67, 120

[56] References Cited

U.S. PATENT DOCUMENTS 3,759,435 9/1973 Bone ..... 227/67

4,402,446 9/1983 Suzuki ..... 227/67

4,465,218 8/1984 Furutsu ..... 227/67

*Primary Examiner*—Paul A. Bell

*Attorney, Agent, or Firm*—Dennison, Meserole, Pollack & Scheiner

[57] ABSTRACT

A tag-pin dispensing machine is disclosed, which is for individually successively severing tag pins from a tag-pin assembly having crossbars of tag pins connected to one another and dispensing severed tag pins relative to articles of merchandise and in which a feeder unit is removably mounted in the machine body and, by a connecting member, connected to a shifter driven by a trigger pivotally secured to the machine body.

8 Claims, 25 Drawing Figures

50
25
25a
25d
29
29a
29b
29c
29d
29e
29f
29g
29h
30
30c
20
20b
20c
20d
20e
20f
20g
20i
27
27a
27b
27c
27d
28
35
36
6
Pa
P
p
b
c
D
E
XIII
XIV

TAG-PIN DISPENSING MACHINE

BACKGROUND

The present invention relates to a dispensing machine for tag pins made of a synthetic resin which individually comprise a filament, a head and a crossbar formed at one and the other ends of the filament and which in use are applied and attached one at a time by the machine to various items of merchandise. More specifically, the tag-pin dispensing machine to which the invention pertains comprises a feeder unit removably icorporated in its machine body for individually successively servering a plurality of tag pins connected with their crossbars to one another to altogether form an integral assembly, and delivering the crossbar of each severed tag pin to the position corresponding within the machine to the open rear end of a hollow needle mounted at a front end portion of the machine body.

With reference to the U.S. Pat. No. 3,103,666 for example, this makes an earliest disclosure of tag pins and tag-pin dispensing machines of the type above referred to, and subsequent to such patent, there have been a number of patents and utility model registrations made covering the tag pins and their dispensing machines, which are today very widely utilized in trades particularly of fabrics and fabric made-up goods.

Tag pins in reference are of an extremely small size and normally are produced in the form of an integral tag-pin assembly comprising 35 to 50 tag pins or, in some cases, 75 to 100 or more tag pins. With tag pins today widely put for use, they have a thickness, a width and a length of their heads of 0.8 to 1.0 mm, 3 to 5 mm and 8 to 11 mm respectively, and a diameter and a length of their crossbars of 0.3 to 1.0 mm and 8 to 11 mm respectively, the length of their filaments being 7.0 to 125.0 mm.

Then, for example in the case of such tag pins as having 1.0 mm for the diameter of the crossbar, they are altogether connected through their respective connecting necks to a common runner bar with interspaces corresponding to the diameter of their crossbars, namely 1.0 mm, and are arranged in the form of an integral assembly, like teeth in a comb.

The tag-pin dispensing machine by which to sever tag pins one by one from such tag-pin assembly and apply them to merchandise is provided with a feeding mechanism for cutting individual tag pins at their respective connecting necks and delivering them into a hollow needle mounted in a nose end portion of the machine.

In conventional machines, the feeding mechanism is composed of such as a gear adapted to engage the connecting necks of tag pins, a ratchet to check reverse rotation of the gear, a lever for intermittently driving the gear for rotation, a cam member for driving the lever, and so forth. While the dispensing machine comprises a machine body structured by a first and a second segments, the above recited members of the feeding mechanism, namely the gear, ratchet, lever, cam and so forth, are arranged at their respective one end or side on a first one of the two machine body segments and supported at their respective other end or side by a plate member having a number of holes for therein receiving the shaft for the gear, fixing screws and so forth, and the first and the second machine body segments are aligned with each other and securely assembled together by means of screws.

The tag-pin dispensing machine is relatively complex in structure and includes precisely arranged mechanisms, so that if the machine is once disassembled in cases of troubles for example with the feeding mechanism, it is difficult for persons without a particular knowledge and/or skill to reassemble the machine in a manner of accurately reproducing original relative positions of various machine members.

Today, an enormous number of tag-pin dispensing machines has been distributed in various countries of the world, and it virtually is impracticable for the manufacturers of the machines to recollect all impaired or damaged machines and perform repair thereof.

Difficulties are indicated also in connection with tag-pin assemblies of conventional designs: In conventional tag-pin assemblies, the interspace with which the prescribed number of tag pins are formed on a runner bar in a comb-like structure is so great that the tag pins of an assembly loaded on the machine easily tend to undergo tangling mutually with their heads. Not only that, but also the tag-pin assemblies require largely spaceful containers for packaging. Moreover, the mold for the manufacture of the tag-pin assembly has to be relatively great in size, and the temperature control for the mold is likely to involve a difficulty.

In order to obviate such various difficulties from the standpoint of manufacture and that of handling of tag-pin assemblies, there have of late been developed such tag-pin assemblies with which the space between member tag pins is reduced and crossbars are very closely arranged to one another or such ones in which the crossbars are mutually so closely arranged that they are almost in contact with one another.

Then, however, another difficulty and yet an essential one has arisen: The existing tag-pin dispensing machines make use of such a feeding mechanism which feeds tag pins by means of a gear to engage connecting necks which join tag pins to a runner bar, so that they can no longer feed tag pins of such a tag-pin assembly which is completely devoid of the connecting neck or runner bar or which includes almost no space between member tag pins.

SUMMARY

Accordingly, a primary object of the present invention is to make practicable to with ease assemble or replace the feeding mechanism in tag-pin dispensing machines.

It also is an object of the invention to make operable to dispense tag pins of such an assembly with which the space between member tag pins is extremely small or which is devoid of the connecting neck and the runner bar.

According to the present invention, the above objects are attained by providing a tag-pin dispensing machine characteristically comprising a feeder unit removably incorporated in its machine body for individually successively severing tag pins from a tag-pin assembly in which crossbars of the tag pins are connected to one another and delivering severed tag pins individually successively to the prescribed position within the machine body facing the rear open end of a hollow needle mounted at a nose end portion of the machine, and a connecting member disposed to connect together the feeder unit and a shifter driven by a lever rockably operably attached to the machine body.

The feeding mechanism according to the invention, namely the feeder unit, is removably mounted, so that it is with ease operable to carry out assemblage or replacement thereof. Therefore, in case a user of the machine should suffer from a trouble caused of the feeder unit, what is required of the user to practice is only to obtain a replacement of the feeder unit from the manufacturer of the machine, whereupon the user can with ease make the machine operable in order again.

The feeder unit according to the invention broadly comprises a housing and feeding means, of which the latter comprises:

(a) a cutter element for individually successively severing tag pins from a tag-pin assembly loaded in the machine and similarly delivering the severed tag pins to the prescribed position within the machine body facing the open rear end of a hollow needle secured at a nose end portion of the machine, (b) holding elements disposed at sides of the cutter element and adapted to come to fix in position a group of crossbars before the cutter element leaves the group of crossbars, (c) a driving cam bar disposed rear of the cutter element and the rear one of the holding elements remote from the nose end of the machine for driving the cutter element to sever tag pins one at a time from the loaded tag-pin assembly while the holding elements are in the operative condition or position to fix in position the group of crossbars and deliver the severed tag pins one at a time to the prescribed position facing the open tail end of the hollow needle after the holding elements have left the group of crossbars, and (d) a stopper disposed below the cutter element for appreciably retarding the return motion of the cutter element in relation to the motion of the driving cam bar.

Having the above structural features and arrangements, the machine according to the present invention can individually successively sever and apply to articles tag pins of such an assembly with which the space between tag pins is extremely limited or which is devoid of the connecting neck and the runner bar.

The above and other features and advantages of the present invention will become apparent from considering the following description of a preferred embodiment taken in conjunction with the accompanying drawings.

THE DRAWINGS

Figure 11:
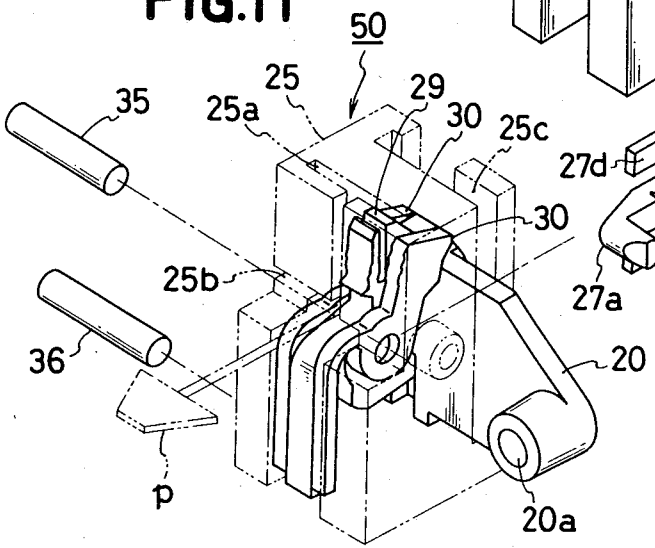
Figures 12, 13, 14, 15, 16:
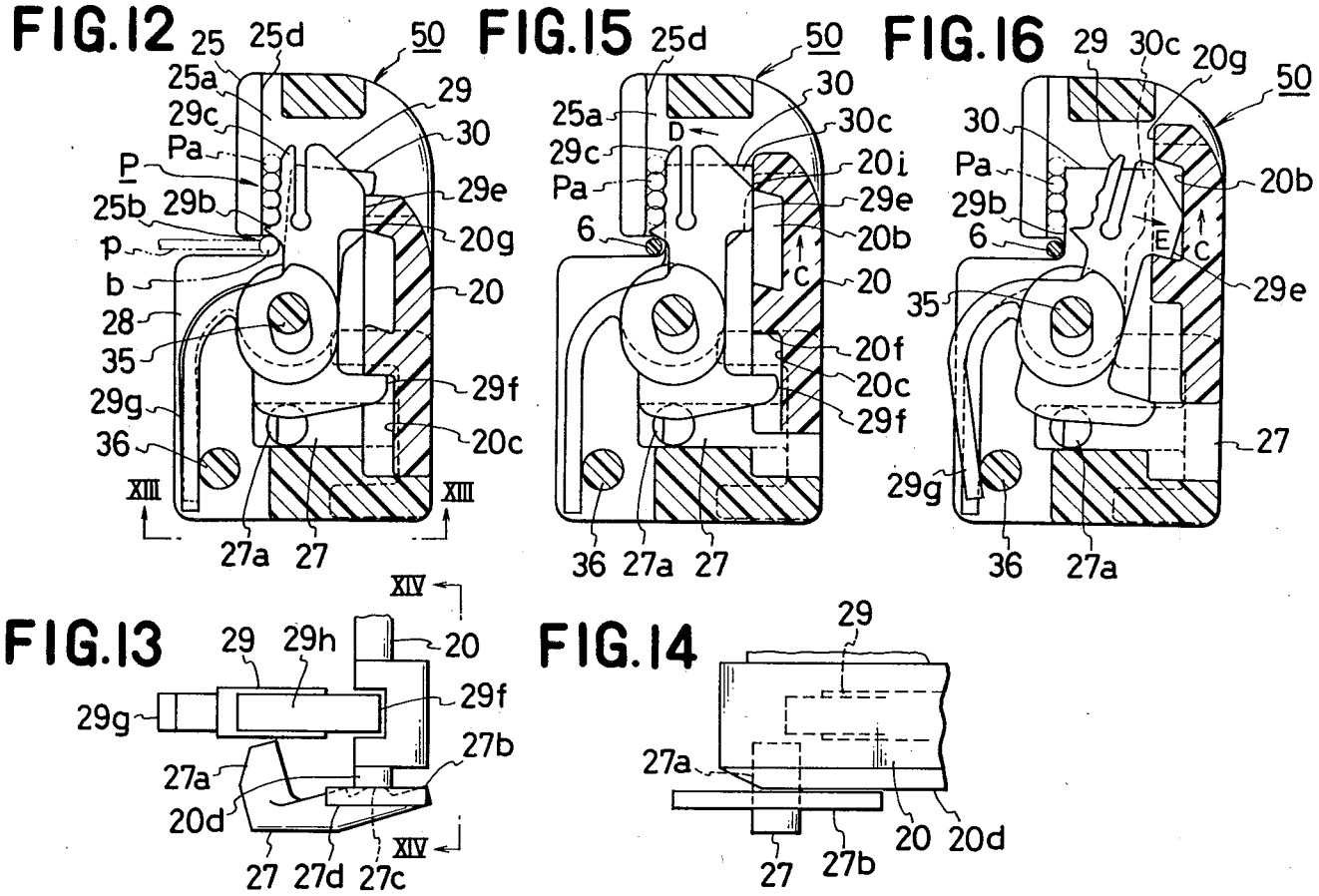
Figure 24:
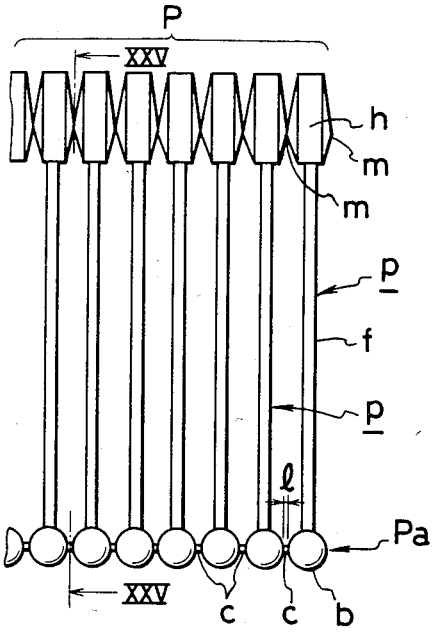
Figure 25:
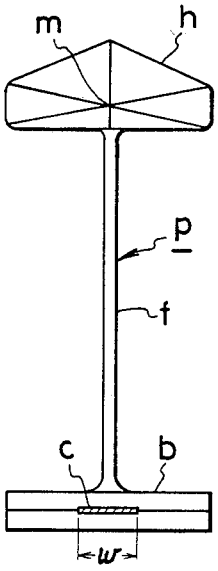

FIG. 11 also shows a perspective view, taken for illustration of essential parts and members of the feeding means assembled in the housing of the feeder unit; FIG. 12 is a view taken for illustration essentially of the feeder unit in a first operation condition of the machine;

FIG. 13 is a partial view taken on line XIII—XIII in FIG. 12;

FIG. 14 also is a partial view, taken on line XIV—XIV in FIG. 13;

FIGS. 15 to 23 are views taken for illustration of various other operation conditions succeeding to the one shown in FIG. 12;

FIG. 24 shows a partial front view of a tag-pin assembly for use in or for the tag-pin dispensing machine according to the present invention; and FIG. 25 is a sectional view taken on line XXV—XXV in FIG. 24.

THE PREFERRED EMBODIMENT (1) Tag-pin assembly:

Before entering a detailed description of the tag-pin dispensing machine of the invention per se, a brief explanation will first be given an assembly of tag pins which the machine of the invention can effectively dispense.

As shown in FIGS. 24 and 25, the tag-pin assembly shown at P comprises a plurality of integrally formed tag pins p, which are arranged like the teeth in or of a comb and which individually comprise a head h, a filament f extended from one end of the head h and a crossbar b formed at the far end of the filament f from the head h. Crossbars b of each adjacent tag pins p are connected together through a film-like connectors c.

On each of its side faces, the head h has a projected central portion m forming an apex of for example a polyangular pyramid, and each adjacent heads h are in contact with each other at their respective central portions m. If desired, the central portions m of adjacent heads h may alternatively be connected to each other in a manner capable of being disconnected with ease.

The connectors c are of a length l of several one-thousandths to several one-hundredths of the diameter of the crossbar b, while their width w being appreciably smaller than the width of the pawl part **29*b* of a cutter element 29 later to be described. The reference character pa in FIG. 24** denotes a group of crossbars b.

Figure 3:
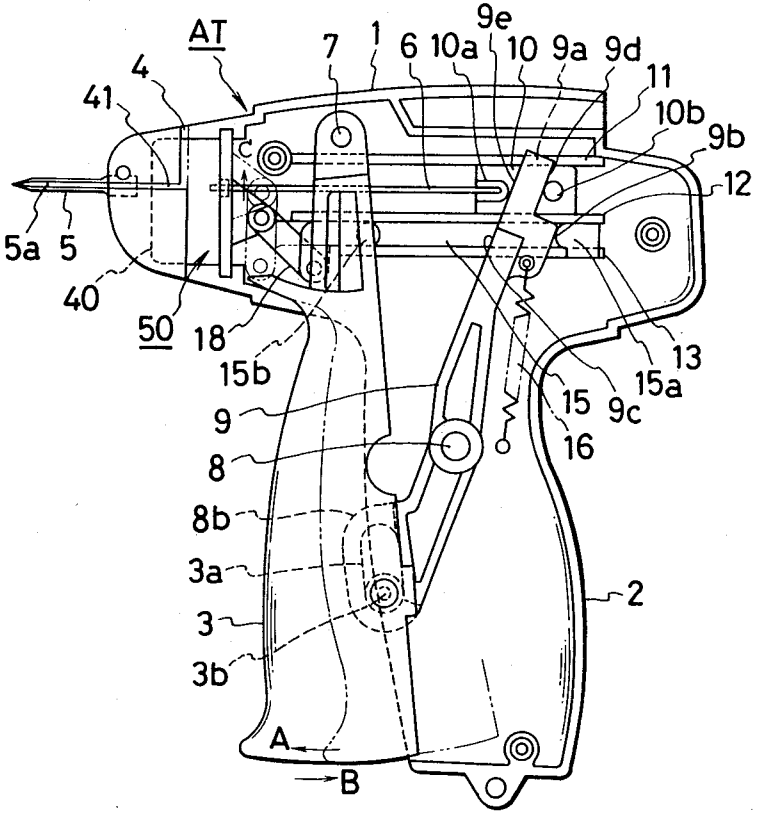
FIG. 3 is a side elevational view, showing the structural detail inside of one of two machine body segments.
Figure 1:
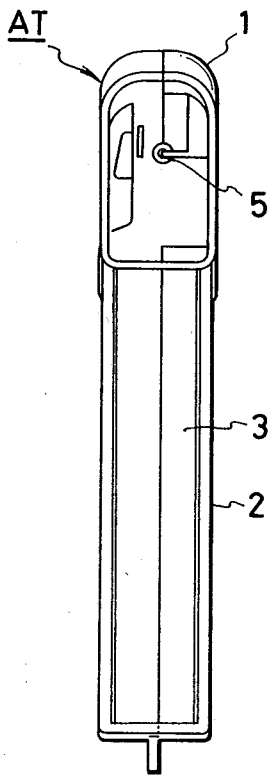
FIG. 1 shows a front elevation of a tag-pin dispensing machine embodying the present invention.
Figure 2:
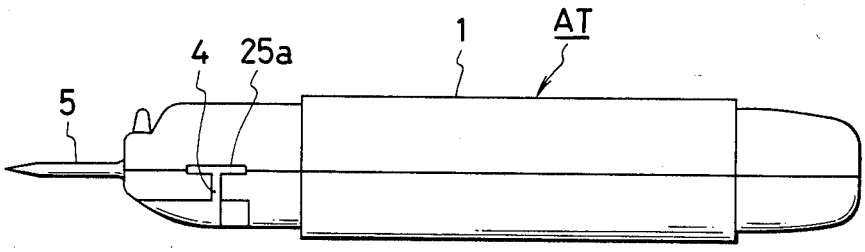
FIG. 2 is a top plan view of the machine of FIG. 1.

(2) General structure of tag-pin dispensing machine:

As shown in FIGS. 1 to 3, the tag-pin dispensing machine according to the present invention, generally indicated at AT, comprises a machine body 1, to which a lever or trigger 3 is pivotably secured by a shaft 7. The lever 3 can be rocked in directions shown by arrows A and B with the shaft 7 as the center of the rocking motion.

Rocking of the lever 3 causes an intermediate lever 9 to rock, which is also pivotally secured by a shaft 8 in a grip handle 2 of the machine body 1. At its top end portion **9*a*, the intermediate lever 9 engages a piston 10 and drives it to reciprocate in forward and backward directions along rails 11 and 12**.

Below the rail 12, there is disposed a further rail 13, and a shifter 15 is disposed between these rails 12 and 13 so as to be slidably reciprocated, similar to the piston 10.

Between the intermediate lever 9 and a point in the grip handle 2, a spring 16 is mounted so that the trigger 3 can normally be forced toward the front or in the direction to come out of the grip handle 2.

Figure 4:
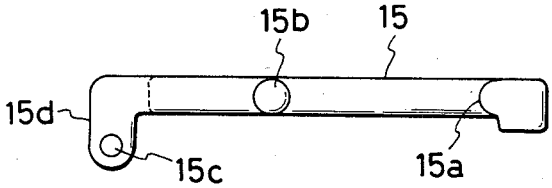
FIG. 4 shows a side elevation of the shifter.
Figure 5:
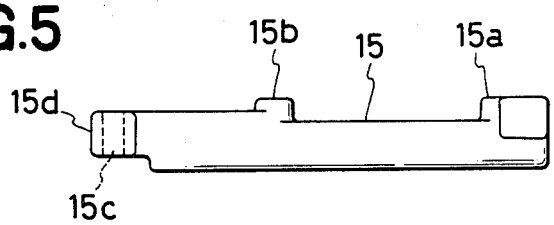
FIG. 5 is a bottom plan of the shifter.

As best seen from FIGS. 4 and 5, the shifter 15 comprises a generally L-shaped member and has projections **15*a* and 15*b* formed respectively at a rear end portion and at a point slightly in front of the center of the length thereof. In its front end portion 15*d*, the shifter 15 is also formed with an aperture 15*c* for therein receiving a pin on a connecting member or lever 18** later to be described.

This shifter 15 is driven by the intermediate lever 9, which has a lower end part 8*b* formed with a slot 3*a*, into which a pin 3*b* fixed on the trigger 3 is loosely fitted.

The top end portion 9*a* of the intermediate lever 9, which is appreciably reduced in thickness, is located on this side of the piston 10 on the sheet of drawings of FIG. 3, and with its contact faces 9*d* and 9*e* on its front side and rear side respectively, it engages projections 10*a* and 10*b* formed on the piston 10 to forwardly and backwardly drive the piston. The piston is provided with a driver 6 with which to push the crossbar b of the tag pin p.

Slightly below the top end portion 9*a*, the intermediate lever 9 is formed with a rear operation face 9*b*, which engages the projection 15*a* on the shifter 15, while a front operation face 9*c* on the opposite side of the lever 9 with respect to the rear operation face 9*a* engages the other projection 15*b* on the front side of the shifter 15.

Figure 6:
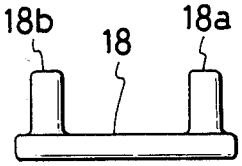
FIG. 6 shows a plan view of the connecting member.

As shown in FIG. 3, the above referred-to connecting member or lever 18 comprises an elongated member, and as best seen from FIG. 6, it is provided with pins 18*a* and 18*b*, of which the former is received in the aperture 15*c* in the shifter 15, the latter being fitted in an aperture 20*a* formed in a driving cam bar 20 later to be described, so that as the shifter 15 is forwardly and backwardly reciprocated, the driving cam bar 20 is driven toward up and down.

FIG. 3 also shows a feeder unit, which is shown at 50 and is received in an easily removable manner in a cavity 40 formed in a front end part of the machine body 1.

The tag-pin dispensing machine AT has a hollow needle 5 secured at a front or nose end portion of the machine body 1. On this side on the sheet of drawings of FIG. 3, the needle 5 is formed with a side slot 5*a*, which is in alignment with a side slot 41 formed in the machine body 1, and the side slot 41 of the machine body is in alignment with a guide groove 25*b* in a housing 25 of the feeder unit 50 later to be described, whereby the guide groove 25*b* is in alignment with the open rear of tail end of the side-slotted hollow needle 5.

Figure 10:
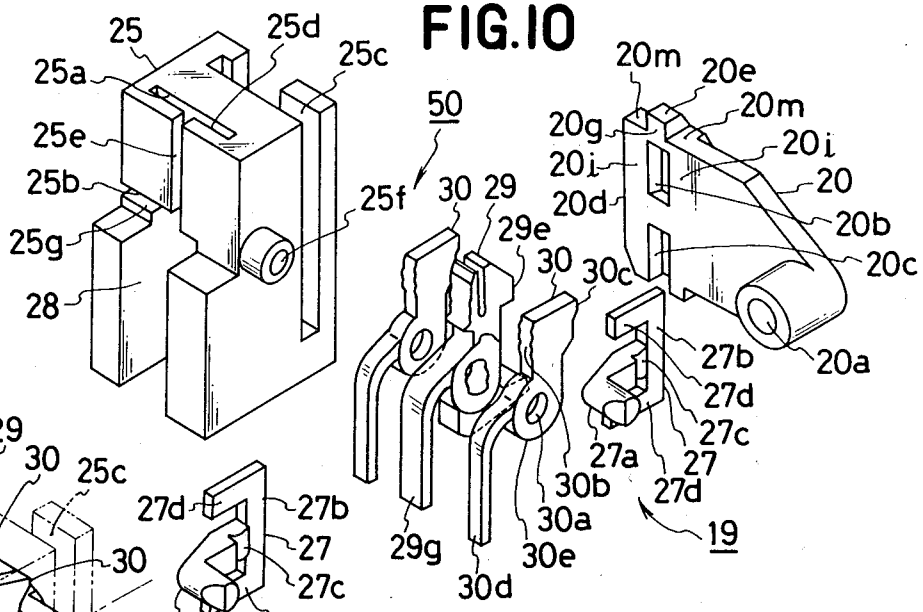
FIG. 10 is a perspective view, showing essential parts and members of the feeder unit.

(3) Feeder unit:

As shown in detail in FIG. 10, the feeder unit 50 is composed of the housing 25 and feeding means 19.

Figure 7:
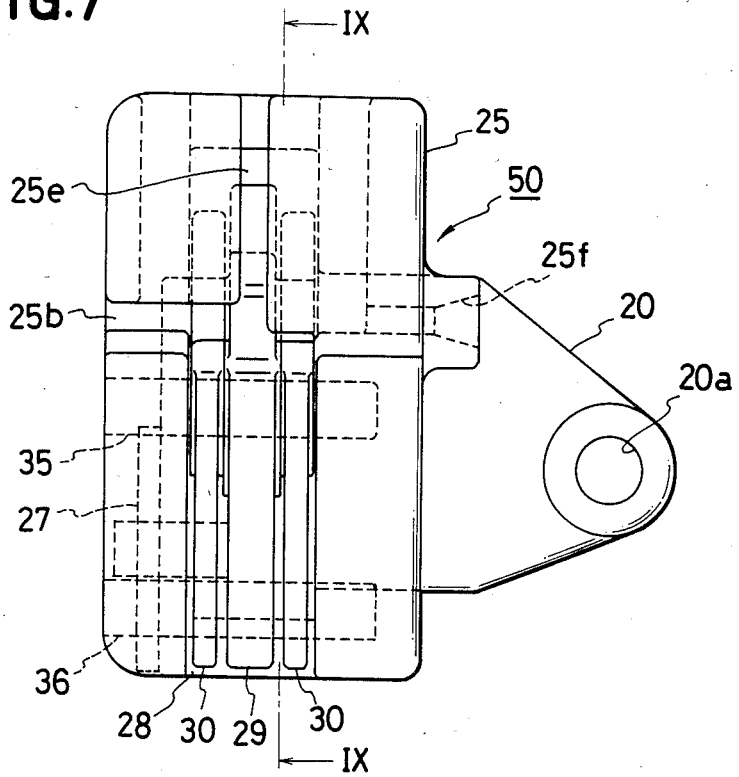
FIG. 7 shows a front elevation of the feeder unit.
Figure 8:
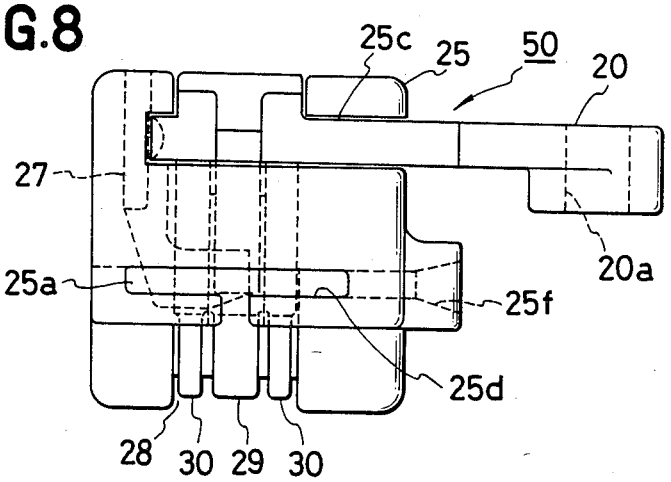
FIG. 8 is a plan view of the feeder unit.

Then, with reference to FIGS. 7 and 8, it will be seen that the feeding means 19 comprises the driving cam bar 20 located on the rear side of the housing 25 and received in a vertically elongated guide groove 25*c* (FIG. 10) in the housing, a stopper 27 to be driven by the driving cam bar 20, a cutter element 29 accommodated in a chamber 28 open at the front side of the housing 25, and holding elements 30 disposed at the front and the rear sides of the cutter element 29.

As shown in FIG. 10, the stopper 27 comprises a fixation part 27*b* functioning as a spring, an L-shaped protuberant part 27*a* projected from a middle point of the fixation part 27*b*, and a compressing face 27*c* at a root portion of the protuberant part 27*a*. This stopper 27 is fitted in a lower rear portion of the housing 25 with its arm 27*d*.

As shown also in FIG. 10, the driving cam bar 20 has at its one end portion the aforementioned aperture 20*a* into which the pin 18*b* of the connecting lever 18 is inserted, and at its other end, a cam 20*d* to operate the stopper 27. This cam bar 20 is further provided with a cavity 20*b* permitting a cam 29*e* of the cutter element 29 to enter and a cavity 20*c* permitting a projection 29*f* (FIG. 9) also of the cutter element 29 to enter.

Figure 9:
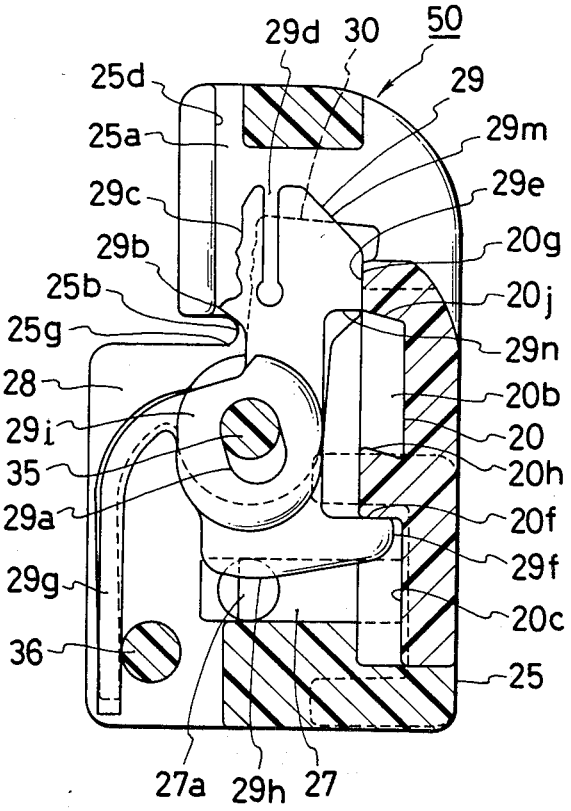
FIG. 9 shows a sectional view taken on line IX—IX in FIG. 7.

FIG. 9 shows such an arrangement in which the upper surface of the bottom wall of the cavity 20*b* forms a push-up portion 20*h* which engages a jaw part 29*n* of the cutter element 29 and raises the element 29 by a distance virtually corresponding to one pitch of tag pins p in the tag-pin assembly, while the lower surface of the top wall of the cavity 20*b* forming a push-out portion 20*j* which presses against an inclined face 29*m* of the cutter element 29 and brings the element 29 to a stand-up position. Also, the lower surface of the top wall of the cavity 20*c* forms a compression portion 20*f* which engages the projection 29*f* of the cutter element 29 and presses the element 29 towards below.

Further, as shown in FIG. 10, the face on the front side (that is, this side on the sheet of drawings of FIG. 10) of a head part 20*e* above the cavity 20*b* is made a bearing face 20*g* against the cam 29*e* of the cutter element 29.

Also in FIG. 10, on each side of the cavity 20*b*, bearing surfaces 20*i* are formed, for pressing against cams 30*c* of the holding elements 30, and on each side of the head part 20*e*, shoulders 20*m* are formed.

The cutter element 29 is operative to cut the film-like connectors c joining together the two crossbars b of each adjacent tag pins p, and as best seen in FIG. 9, it has in a central portion of its body 29*i* a slot 29*a* for therein receiving a pin 35 and comprises a pawl part 29*b* formed above the slot 29*a* and a crossbar holder part 29*c* having a concave-convex profile compensatory for the outer configuration as a whole of the group of crossbars pa. So that it can exhibit a spring force, the crossbar holding part 29*c* is formed with a slit 29*d* in an upper portion of its body 29*i*.

Advantageously, the pawl part 29*b* should have a width appreciably greater than that of the connector c connecting together the crossbars b of each adjacent tag pins p.

Further, the cutter element 29 has a cam 29*e*, which is provided at the rear side (that is, the far side on the sheet of drawings of for example FIG. 10) of an upper portion of the element body 29*i*. The upper side of this cam 29*e* is made the inclined face 29*m*, while the lower side is made the jaw part 29*n*. The cutter element 29 is provided in a lower portion of its body 29*i* with a pressure part 29*h* to engage the stopper 27, and this pressure part 29*h* is provided with the projection 29*f* to engage the compression portion 20*f* of the driving cam bar 20. The body 29*i* of the cutter element 29 is provided with a spring part 29*g* which is projected toward the front of the body 29*i* and is bent toward below.

The holding elements 30 are operative to prevent the crossbars group pa from moving during when, after the cutter element 29 has departed from the crossbars group pa, it accomplishes cutting or severing of a first located tag pin p of the tag-pin assembly P, and as shown in FIG. 10, each holding element 30 is provided in a central portion of its body 30*e* with an aperture 30*a* for passing the pin 35 through. It further comprises a holder part 30*b* in a front upper portion of the body 30*e* and a cam 30*c* on the rear side. The holder part 30*b* has a concave-convex profile compensatory for the outer configuration as a whole of crossbars of the group pa. Similar to the above described cutter element 29, the holding elements 30, too, are provided with spring parts 30*d* on the front side of their bodies 30*e*.

The housing 25 of the feeder unit 50 under reference is provided with a guide groove 25*a* for therein receiving and guiding the group of crossbars pa of the tag-pin assembly P. The crossbars group pa is normally pressed against the front wall 25*d* of the guide groove 25*a* by the holder part 29*c* of the cutter element 29.

The spring part 29*g* of the cutter element 29 is located fairly distant forwardly from the location of the pin 35 and, at the same time, born against a pin 36 mounted in the chamber 28 in the housing 25, so that the cutter element 29 is always actuated to rotate in the clockwise direction. Similar to this, the holding elements 30, too, are actuated to rotate in the clockwise direction through engagement of their spring parts 30*d* with the pin 36.

As shown in FIG. 10, further, the housing 25 is provided also with a guide bore 25*f* for passing the piston pin 6 through, this bore 25*f* being concentrical or in alignment with the guide groove 25*b*. Guide grooves 25*a* and 25*b* in the housing have a common bottom wall 25*g*. A further groove 25*e* which extends perpendicular to the groove 25*a* is for passing the filament f of the tag pin p, and is in alignment with a loading groove 4 (FIG. 3) provided in the machine body 1.

Now, a description will be entered into the operation of the above described tag-pin dispensing machine of the invention:

(i) Driving of a first tag pin:

FIG. 12 shows an operation condition immediately before a first tag pin p of the loaded tag-pin assembly P is to be driven shot relative to an object or an article of merchandise, in which the first tag pin p severed from the tag-pin assembly P is set in the guide groove 25*b*. In this condition, the bearing face 20*g* of the elements driving cam bar 20 compressing the cam 29*e* of the cutter element 29 toward left, the crossbars group pa is pressed against the front wall 25*d* of the guide groove 25*a* by the holder part 29*c* of the cutter element 29. While the crossbars group pa is thus maintained in position by the holder part 29*c* of the cutter element 29, the holding elements 30 are detached from the crossbars group pa.

The hollow needle 5 has previously been applied through a tag or label and an article not shown, and in this condition, the operation lever or trigger 3 may be pulled in the direction of the arrow B in FIG. 3, whereupon the crossbar b of the first tag pin p is pushed into the hollow needle 5 by the piston pin 6.

In the operation condition under reference, as shown in FIGS. 13 and 14 the cam 20*d* of the elements driving cam bar 20 presses against the compressing face 27*c* of the stopper 27, so that the protuberant part 27*a* of the stopper is in a retracted position not in contact with the cutter element 29.

(ii) Fixation of crossbars group by holding elements:

When, during a forward motion of the driver 6, the operation face 9*c* of the intermediate lever 9 comes into contact with the projection 15*b* and forwardly drives the shifter 15, the driving cam bar 20 is moved in the direction of an arrow C by the connecting member 18. Then, as shown in FIG. 15, the cam 30*c* of the holding element 30 undergoes rotation in the direction of an arrow D as a result of being pressed by the bearing surface 20*i* of the cam bar 20, whereby the crossbars group pa becomes pressed against the front wall 25*d* of the guide group 25*a* by the holder parts 30*b* of the holding elements 30.

(iii) Retraction of cutter element:

As shown in FIG. 16, then, as the cam bar 20 is further raised in the direction of the arrow C, the engagement between the cam 29*e* of the cutter element 29 and the bearing face 20*g* of the cam bar 20 becomes released, whereby the cutter element 29 is rotated by the reaction force of the spring part 29*g* in the direction shown by an arrow E, whereupon the cam 29*e* is driven into the cavity 20*b*.

Figures 17, 18, 19, 20, 21, 22, 23:
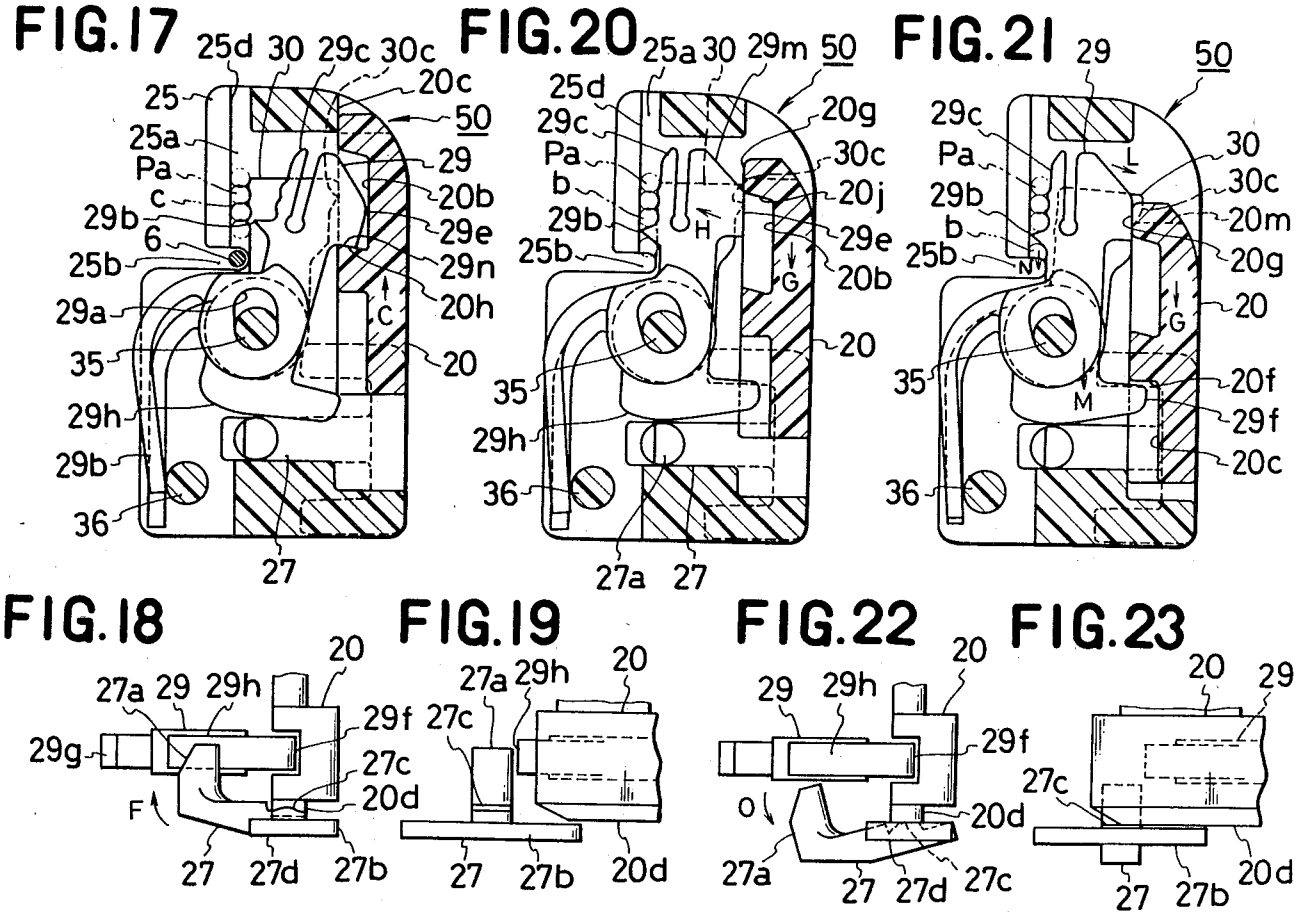

(iv) Raising of cutter element:

When the cam bar 20 is further lifted in the direction of the arrow C, as shown in FIG. 17 the push-up portion 20*h* of the driving cam bar 20 and the jaw part 29*n* of the cam 29*e* of the cutter element 29 become engaged with each other to raise the cutter element 29 substantially corresponding to the pitch of tag pins p in the tag-pin assembly.

When the driving cam bar 20 is raised to its possible highest position as above, as shown in FIGS. 18 and 19 the engagement between the cam 20*d* of the cam bar 20 and the compressing face 27*c* of the stopper 27 becomes released, whereby the protuberant part 27*a* is caused to undergo a return motion in the direction of an arrow F by the reaction force of the fixation part 27*b* fixed to the housing 25 and, as shown in FIG. 19, comes to project below the pressure part 29*h* of the cutter element 29.

As a result of the above, the crossbar b and a portion of the filament f of the tag pin p is applied by the driver 6 from this side to the other side of an article of merchandise through the hollow needle 5.

(v) Severing of tag pins:

As the gripping at the trigger 3 is then gradually released, the trigger 3 and its associated members and parts which were moved during the preceding tag-pin shooting operation are permitted to return to their respective original positions illustrated in FIG. 3. In this connection, when the intermediate lever 9 undergoes the return motion, first the piston pin 6 is retracted and then the operation face 9*b* of the lever 9 pushes the projection 15*a* of the shifter 15 to retract the shifter toward right in FIG. 3. Upon this, the driving cam bar 20 undergoes lowering in the direction shown by an arrow G in FIG. 20.

As above described, the protuberant part 27*a* of the stopper 27 is projected below the pressure part 29*h* of the cutter element 29, whereby the lowering motion of the cutter element 29 is interrupted by the stopper 27 and the driving cam bar 20 alone is allowed to further descend.

As a result of that the inclined face 29*m* of the cutter element 29 and the push-out portion 20*j* of the cavity 20 become engaged with eath other, then, the cam 29*e* of the cutter element 29 becomes pushed out of the cavity 20 in the direction of an arrow H. The pawl part 29*b* is then brought between the crossbar b of a tag pin p to be next driven and the crossbar b of the immediately above located tag pin p and cuts the connector c at that position. At the same time as this, the crossbars group pa is pressed against the front wall 25*d* of the guide groove 25*a* by the holder part 29*c*.

(vi) Setting of tag pins:

As shown in FIG. 21, the driving cam bar 20 is further lowered in the direction of an arrow G, when the cam 30*c* comes disengaged from the shoulder 20*m* of the cam bar 20, so that the holding element 30 can rotate in the direction of an arrow L to allow its holder part 30*b* to depart from the crossbars group pa.

At that time, the cam or cam surface 20*d* of the driving cam bar 20 contacts the compressing face 27*c* of the stopper 27 as shown in FIG. 22, and the protuberant part 27*a* leaves the cutter element 29 and retracts in the direction of an arrow O.

Further, as the driving cam bar 20 undergoes lowering in the direction of the arrow G, the compression portion 20*f* forming a wall of the cavity 20*c* and the projection 29*f* of the cutter element 29 come to engage each other, whereby the cam bar 20 as well as the cutter element 29 are caused to lower in the direction of an arrow M in FIG. 21. Accompanying this, a then first located tag pin p which has been severed from the tag-pin assembly P is lowered by the pawl part 29*b* in the direction of an arrow N in FIG. 21 and becomes set in the guide groove 25*b*.

At last, the hollow needle 5 applied through an article will then be pulled out of the article to accomplish the application of a tag pin p.

It should be understood that the present invention is not limited in its scope only to the above described specific embodiment, the invention being to be taken to be limited within the scope of the claims that follow.

I claim:

1. A tag-pin dispensing machine comprising a machine body (1), a feeder unit (50) removably mounted in the machine body (1) for individually successively severing tag pins p of a tag-pin assembly P comprising a number of tag pins p having their crossbars b connected to one another, and delivering each severed tag pin p to the prescribed position corresponding within the machine body (1) to the open tail end of a hollow needle (5) mounted in a nose end portion of the machine body (1), and a shifter (15) driven by a trigger (3) pivotally secured to the machine body (1), said feeder unit (50) and said shifter (15) being connected toether by a connecting member (18), said feeder unit (50) comprising a housing (25) and feeding means (19) assembled in the housing (25), said feeding means (19) comprising a cutter element (29) for individually successively severing tag pins p from the tag-pin assembly P and delivering each severed tag-pin p to the prescribed position corresponding within the machine body (1) to the open tail end of the hollow needle (5), said feeder unit (50) being structured so as to enable removal of said feeder unit (50) as an integral assembly from said machine body (1) and said connecting member (18).

2. A tag-pin dispensing machine as claimed in claim 1, wherein said housing (25) has a guide groove (25*a*) for passing and guiding a group pa of crossbars b of the tag-pin assembly p through and, at the bottom of said guide groove (25*a*), a further guide groove (25*b*) open in the position of the open tail end of the hollow needle (5).

3. A tag-pin dispensing machine as claimed in claim 1, wherein said feeding means (19) comprises:

(a) holding elements (30) disposed at the sides of said cutter element (29) and adapted to come to fix in position a group pa of crossbars b of the tag-pin assembly p before said cutter element (29) leaves the group of crossbars pa, (b) a driving cam bar (20) disposed rear of said cutter element (29) and the rear one of said holding elements (30) remote from the nose end of the machine body (1), for driving said cutter element (29) to sever tag pins p one at a time from the tag-pin assembly p while said holding elements (30) are in the operative condition or position to fix in position the group of crossbars pa and deliver the severed tag pins p one at a time to the prescribed position corresponding within the machine body (1) to the open tail end of the hollow needle (5) after said holding elements (30) have left the group of crossbars pa, and (c) A stopper (27) disposed below said cutter element (29) for appreciably retarding the return motion of said cutter element (29) in relation to the returning motion of said driving cam bar (20).

4. A tag-pin dispensing machine as claimed in claim 1, wherein said feeder unit (50) comprises:

(a) a housing (25) having a guide groove (25*a*) for passing and guiding a group of crossbars pa of the tag-pin assembly p through and a front wall (25*d*) of said guide groove (25*a*) against which the group of tag pins pa is pressed, (b) a cutter element (29) having a pawl part (29*b*) and a holder part (29*c*), which are actuated in a direction departing from said front wall (25*d*) of the guide groove (25*a*), said cutter element (29) being pivotally supported in said housing (25) in a manner capable of being raised and lowered, (c) holding elements (30) pivotally supported within said housing (25), at the sides of said cutter element (29), each of said holding elements (30) having a holder part (30*b*) actuated in a direction departing from said front wall (25*d*) of the guide groove (25*a*), (d) a driving cam bar (20) disposed rear of said cutter element (29) and the rear one of said holding elements (30) remote from the nose end of said machine body (1), said driving cam bar (20) comprising a push-up portion (20*h*) to engage a jaw part (29*n*) of said cutter element (29) and raise the element (29) by a distance virtually corresponding to the pitch of tag pins p in the tag-pin assemby p, a compression portion (20*f*) to engage a projection (29*f*) of said cutter element (29) and lower the element (29), a push-out portion (20*j*) to press against an inclined face (29*m*) of said cutter element (29) and bring the element (29) to a stand-up position, a bearing face (20*g*) to press against a cam (29*e*) of said cutter element (29) and rotate the element (29) toward said front wall (25*d*) of the guide groove (25*a*), a further bearing face (20*i*) to press against a cam (30*c*) of said holding elements (30) and rotate the elements (30) toward said front wall (25*d*) of the guide groove (25*a*), and a cam (20*d*) to engage a compressing face (27*c*) of a stopper (27) and retract protuberant part (27*a*) of said stopper (27) from below said cutter element (29), and (e) said stopper (27), which is disposed below said cutter element (29) for appreciably retarding the return motion of said cutter element (29) in relation to the returning motion of said driving cam bar (20).

5. A tag-pin dispensing machine as claimed in claim 1 wherein said feeder unit (50) for individually successively severing tag pins p of a tag-pin assembly P comprises means for severing the tag-pins p from each other at the connection between their crossbars b.

6. A tag-pin dispensing machine as claimed in claim 1 including holding elements (30) disposed at the sides of said cutter element (29) and adapted to come to fix in position a group pa of crosbars b of the tag-pin assembly P before said cutter element (29) leaves the group of crossbars pa.

7. A tag-pin dispensing machine comprising a machine body (1), a feeder unit (50) removably mounted in the machine body (1) for individually successively severing tag pins p of a tag-pin assembly P comprising a number of tag pins p having their crossbars b connected to one another, and delivering each severed tag pin p to the prescribed position corresponding within the machine body (1) to the open tail end of a hollow needle (5) mounted in a nose end portion of the machine body (1), and a shifter (15) driven by a trigger (3) pivotally secured to the machine body (1), said feeder unit (50) and said shifter (15) being connected toether by a connecting member (18), said feeder unit (50) comprising a housing (25) and feeding means (19) assembled in the housing (25), said feeding means 19 comprising:

(a) a cutter element (29) for individually successively servering tag-pins p from the tag-pin assembly P and delivering each severed tag pin p to the prescribed position corresponding within the machine body (1) to the open tail end of the hollow needle (5), (b) holding elements (30) disposed at the sides of said cutter element (29) and adapted to come to fix in position a group pa of crossbars b of the tag-pin assembly P before said cutter element (29) leaves the group of crossbars pa, (c) a driving cam bar (20) disposed rear of said cutter element (29) and the rear one of said holding elements (30) remote from the nose end of the machine body (1), for driving said cutter element (29) to sever tag-pins p one at at time from the tag-pin asembly P while said holding elements (30) are in the operative condition or position to fix in position the group of crossbars pa and deliver the severed tag-pins p one at a time to the prescribed position corresponding within the machine body (1) to the open tail end of the hollow needle (5) after said holding elements (30) have left the group of crossbars pa, and (d) a stopper (27) disposed below said cutter element (29) for appreciably retarding the return motion of said cutter element (29) in relation to the returing motion of said riving cam bar (20).

8. A tag-pin dispensing machine comprising a machine body (1), a feeder unit (50) removably mounted in the machine body (1) for individually successively severing tag pins p of a tag-pin assembly P comprising a number of tag pins p having their crossbars b connected to one another, and delivering each severed tag pin p to the prescribed position corresponding within the machine body (1) to the open tail end of a hollow needle (5) mounted in a nose end portion of the machine body (1), and a shifter (15) driven by a trigger (3) pivotally secured to the machine body (1), said feeder unit (59) and said shifter (15) being connected toether by a connecting member (18), said feeder unit (50) comprising a housing (25) and feeding means (19) assembled in the housing (25), said feeder unit (50) comprising:

(a) a housing (25) having a guide groove (25*a*) for passing and guiding a group of crossbars pa of the tag-pin assembly P through a front wall (25*d*) of said guide groove (25*a*) against which the group of tag-pins pa is pressed, (b) a cutter element (29) having a pawl part (29*b*) and a holder part (29*c*), which are actuated in a direction departing from said front wall (25*d*) of the guide groove (25*a*), said cutter element (29) being pivotally supported in said housing (25) in a manner capable of being raised and lowered, (c) holding elements (30) pivotally supported within said housing (25), at the sides of said cutter element (29), each of said holding elements (30) having a holder part (30*b*) actuated in a direction departing from said front wall (25*d*) of the guide groove (25*a*), (d) a driving cam bar (20) disposed rear of said cutter element (29) and the rear one of said holding elements (30) remote from the nose end of said machine body (1), said driving cam bar (20) comprising a push-up portion (20*h*) to engage a jaw part (29*n*) of said cutter element (29) and raise the element (29) by a distance virtually corresponding to the pitch of tag pins p in the tag-pin assembly P, a compression portion (20*f*) to engage a projection (29*f*) of said cutter element (29) and lower the element (29), a push-out portion (20*j*) to press against an inclined face (29*m*) of said cutter element (29) and bring the element (29) to a stand-up position, a bearing face (20*g*) to press against a cam (29*e*) of said cutter element (29) and rotate the element (29) toward said front wall (25*d*) of the guide groove (25*a*), a further bearing face (20*i*) to press against a cam (30*c*) of said holding elements (30) and rotate the elements (30) toward said front wall (25*d*) of the guide groove (25*a*), and a cam (20*d*) to engage a compressing face (27*c*) of a stopper (27) and retract protuberant part (27*a*) of said stopper (27) from below said cutter element (29), and (e) said stopper (27), which is disposed below said cutter element (29) for appreciably retarding the return motion of said cutter element (29) in relation to the returning motion of said driving cam bar (20).

* * * * *